US005791163A

United States Patent [19]

Throneburg

[11] Patent Number: 5,791,163

[45] **Date of Patent: *Aug. 11, 1998**

[54] KNIT FOOT PROTECTOR HAVING INTEGRAL PADDING AND METHOD OF KNITTING SAME

[76] Inventor: James L. Throneburg, 625 W. Bell St., Statesville, N.C. 28687

[ * ] Notice: The term of this patent shall not extend beyond the expiration date of Pat. No. 5,560,226.

[21] Appl. No.: 721,101

[22] Filed: Sep. 26, 1996

[51] Int. Cl.[6] ..... D04B 1/26; A41B 11/02

[52] U.S. Cl. ..... 66/178 R; 66/185; 66/186; 66/187; 66/194; 2/239; 2/240

[58] Field of Search ..... 66/185, 171, 186, 66/187, 178 R, 194; 2/239, 240

[56] References Cited

U.S. PATENT DOCUMENTS

| | | | |
|---|---|---|---|
| 1,741,340 | 12/1929 | Scholl | 2/239 |
| 1,889,716 | 11/1932 | Walker . | |
| 2,102,368 | 12/1937 | Martel . | |
| 2,144,563 | 1/1939 | Davis . | |
| 2,333,373 | 11/1943 | Grey . | |
| 2,391,064 | 12/1945 | McCandless . | |
| 2,687,528 | 8/1954 | Paul . | |
| 2,771,691 | 11/1956 | Luchs | 2/239 X |
| 2,790,975 | 5/1957 | McCormick | 2/239 |
| 3,085,410 | 4/1963 | Loizillon . | |
| 3,102,271 | 9/1963 | Wilkerson . | |
| 3,274,709 | 9/1966 | Lipinski . | |
| 3,796,067 | 3/1974 | East . | |
| 4,194,249 | 3/1980 | Throneburg . | |
| 4,253,317 | 3/1981 | Howard et al. . | |
| 4,255,949 | 3/1981 | Throneburg . | |
| 4,263,793 | 4/1981 | Safrit et al. . | |
| 4,277,959 | 7/1981 | Throneburg . | |
| 4,341,096 | 7/1982 | Safrit et al. . | |
| 4,373,361 | 2/1983 | Throneburg . | |
| 4,520,635 | 6/1985 | Shields et al. . | |
| 4,615,188 | 10/1986 | Hursh et al. . | |
| 4,651,354 | 3/1987 | Petrey | 2/239 |
| 4,732,015 | 3/1988 | Abrams et al. . | |
| 5,230,333 | 7/1993 | Yates et al. | 2/239 X |
| 5,307,522 | 5/1994 | Throneburg et al. . | |
| 5,335,517 | 8/1994 | Throneburg et al. . | |
| 5,560,226 | 10/1996 | Thorneburg | 66/185 |

FOREIGN PATENT DOCUMENTS

| | | |
|---|---|---|
| 0593394 | 4/1994 | European Pat. Off. . |
| 453979 | 9/1936 | United Kingdom . |
| WO 96/21366 | 7/1996 | WIPO . |

*Primary Examiner*—John J. Calvert
*Attorney, Agent, or Firm*—Bell Seltzer Intellectual Property Law Group of Alston & Bird

[57] ABSTRACT

A foot protector for providing cushioning comfort and support to the foot of a wearer is described. The foot protector has a toe portion, a ball portion and an instep portion, and a pad positioned on the ball portion. The pad has an arcuate front edge, and the pad is positioned on the foot protector such that the arcuate front edge of the pad is located proximate the juncture of the toe portion and the ball portion, such that the transition from the padded region to the relatively less padded region is positioned below the toe joints, where it is not readily felt by the wearer. The padding can be formed during the knitting process, with the padding being formed by a plurality of terry loops.

18 Claims, 3 Drawing Sheets

KNIT FOOT PROTECTOR HAVING INTEGRAL PADDING AND METHOD OF KNITTING SAME

FIELD OF THE INVENTION

This invention relates generally to a foot protector and more specifically to a knit foot protector having integral padding for cushioning and protecting a wearer's feet.

BACKGROUND OF THE INVENTION

The sole of the human foot is typically the only portion of a person's body which effectively contacts the ground when the person is standing, walking or the like and thus, the full weight of a person's body is often concentrated for extended periods of time in a small dimensional area relative to the size of the body. As a result, the pressures sustained by the feet are generally very high, particularly on the foot sole. Additional shock forces are sustained during walking, running and the like, as the feet are repeatedly contacted with the ground, usually at great force. As a result, in the course of his or her life, virtually every person experiences some form of foot discomfort, be it from routine motions such as standing, walking and running or isolated instances of overexertion.

Various attempts have been made to design footwear which is comfortable to the wearer. Such attempts have generally been directed at either modifying shoe structure or the structure of the socks worn within the shoes. Modifications to standard shoe structures themselves have not achieved optimal comfort for individual wearers, since no two feet are alike and it is the rare consumer who can afford all custom-fit shoes. Thus, socks designed to enhance comfort have generally had more commercial appeal.

Examples of prior comfort-enhancing foot coverings are described in commonly-assigned U.S. Pat. Nos. 4,194,249, 4,255,949, 4,277,959, 4,373,361, and 5,335,517, and application Ser. No. 08/371,877. The foot protectors of the '959, '517, '949, '361, and '249 patents are in the form of socks, each of which has specially-shaped padded regions to provide protection for specific portions of a wearer's foot. For example, the sock of the '959 patent has padding provided on the heel, ball and inner arch areas, in order to provide cushioning during running and jogging, while the sock of the '517 patent has different padding thicknesses in different areas of the sock, with the thickest padding being in the ball and heel, the thinnest padding in arch and instep portions of the sock, and padding of intermediate thickness being knit in a toe portion of the sock. The '949 patent describes a sock having shock absorber pads on the toe, ball, arch and heel, with the padding being thickest at the inner portion of the arch, while the '361 patent describes a sock having thickened areas on its front and rear portions, with relatively thinner side panels, the structure of which is modified proximate the foot to limit the stretch of the sock. The '249 patent describes an athletic sock having terry loop shock absorber cushions provided on the ball and heel areas of the sock, with relatively less dense terry material being provided proximate the arch portion of the sock.

While these various foot protectors have been found to be effective in many instances, the provision of the thickened padding regions can tend to cause a wearer's shoes to feel too tight on his or her feet. As a result, wearers who intend to wear such padded socks generally purchase their shoes a half to a full size larger than their true size, in order that the shoes are large enough to accommodate the padded socks. While this solves the fit problem for some people, the purchase of shoes in a bigger size can often result in the wearer getting a poor shoe fit despite the use of thickened socks, because the shoe arch can fail to line up properly with the arch of the wearer's foot. Further, the user is then restricted to wearing the larger-sized shoes only with the thickened padded socks.

Commonly-assigned U.S. patent application Ser. No. 08/371,877 addresses some of these problems by providing a foot protector having a substantially T-shaped pad on its sole, with the top bar of the T-shaped pad corresponding to the ball portion of the foot. While providing effective comfort in many applications by minimizing the region of padding, it has been found that some wearers are bothered by the feel of the transition from the relatively thicker pad to the relatively thinner portion proximate the front edge of the pad, as this density change tends to cross undesirably over pressure points of the foot.

Thus, while each of these prior art socks may be effective for certain uses, the padding therein is often found to be too bulky in certain areas, and to undesirably irritate pressure points of the feet.

Therefore, a need exists for a means for providing cushioning comfort to a wearer's feet, while minimizing irritation of the pressure points of the wearer's feet and the bulky feel often associated with padded foot protectors and socks.

In addition, a need exists for a foot protector which provides effective cushioning comfort to a wearer's feet, without causing the wearer's shoes to be unduly tight.

OBJECT AND SUMMARY OF THE INVENTION

With the foregoing in mind, it is an object of the present invention to provide foot protectors which provide cushioning comfort to a wearer's feet, while minimizing the tendency for the foot protector to render a wearer's shoes too tight and uncomfortable.

It is also an object of the present invention to provide a foot protector which provides effective cushioning for the wearer's feet while avoiding irritation of the pressure points of the feet.

These and other objects are accomplished by providing a foot protector having specifically shaped and located cushioning portions for cushioning certain of the pressure points of a wearer's foot, while minimizing undue bulk. The foot protector can be in the form of a conventional sock structure, or it can have a "toe cap" type of construction, where it covers the toes, ball, a portion of the instep, and optionally a portion of the arch, but terminates in a band which extends circumferentially around the arch and instep of the foot. Alternatively, the foot protector can be provided in other basic constructions which can function sufficiently to position the specially shaped padding properly on a wearer's foot.

The specially configured padding of the foot protector of the instant invention is positioned on the protector such that it overlies at least a portion of the ball of a wearer's foot, and desirably includes an arcuate front edge which terminates proximate the juncture of the ball and toes of the foot. In this way, the transition from the relatively thicker region of the specially configured padding to the relatively thinner toe portion is positioned between the ball of the foot and the pads of the toes, i.e. proximate the toe joints, and follows the contour thereof, so that it avoids the pressure points of the feet and thus does not tend to be felt by the wearer.

Although other arcuate-edged shaped pads are within the scope of the invention, in a first form of the invention, the padding is substantially mushroomshaped, and includes a main body or cap portion and a stem, which are joined together along first and second edges. The first and second edges can be shaped substantially as right angles, or can be curved to more closely approximate the true shape of a mushroom. The substantially mushroom-shaped pad is desirably positioned on the foot protector such that the cap portion covers at least a portion of the ball of the foot, and the stem extends toward the rear of the foot and covers a portion of the arch. While other areas of padding may be provided in regions surrounding the substantially mushroom-shaped pad portion in the form of background padding, these padded regions are desirably thinner than the mushroom-shaped area, such that the mushroom-shaped pad remains a prominent region on the protector. Also, while the mushroom-shaped pad desirably has a continuous thickness across its width, it is noted that small sections of the padded region could be substantially less padded, while still providing the overall effect of a padded region on the ball of the foot.

In an alternative embodiment of the invention, a first padded region having an arcuate front edge is provided in the manner described above. In this embodiment, a second pad is positioned on the foot protector to correspond with a central portion of the juncture of the ball and the arch portions of the foot, so as to fill in the region corresponding to the central indentation of the ball pad. In one form of this embodiment of the invention, this second pad is relatively thicker than the first pad. In another such form of this embodiment of the invention, the first pad is substantially mushroom shaped, the second pad is substantially circular, and the second pad is positioned on the mushroom-shaped pad proximate the juncture of the cap and the stem portions.

The foot protector is desirably integrally knit on a sock knitting machine, with the main body of the protector being knit from one or more body yarns, and the padded portions being formed by chopping in one or more auxiliary yarns to form a plurality of terry loops. In the case of the embodiment having the second padded region, an additional yarn can be chopped in to form the second padded region. Following knitting, the foot protector is removed from the knitting machine and finished in a conventional manner, e.g. by seaming opposite sides of the toe region together.

In wear, the foot protector is preferably donned by the wearer so that the terry loops which desirably form the padded sections face inwardly toward the wearer's feet. Besides assisting with moisture absorption, the loops can thus also provide a comfortable cushion for the wearer's feet.

BRIEF DESCRIPTION OF THE DRAWINGS

Other objects and advantages will appear as the description proceeds when taken in connection with the accompanying drawings, in which.

DETAILED DESCRIPTION

The present invention now will be described more fully hereinafter with reference to the accompanying drawings, in which various embodiments of the invention are shown. This invention may, however, be embodied in many different forms and should not be construed as limited to the illustrated embodiments set forth herein; rather, these illustrated embodiments are provided so that this disclosure will be thorough and complete, and will fully convey the scope of the invention to those skilled in the art. Like numbers refer to like elements throughout.

Figure 1:
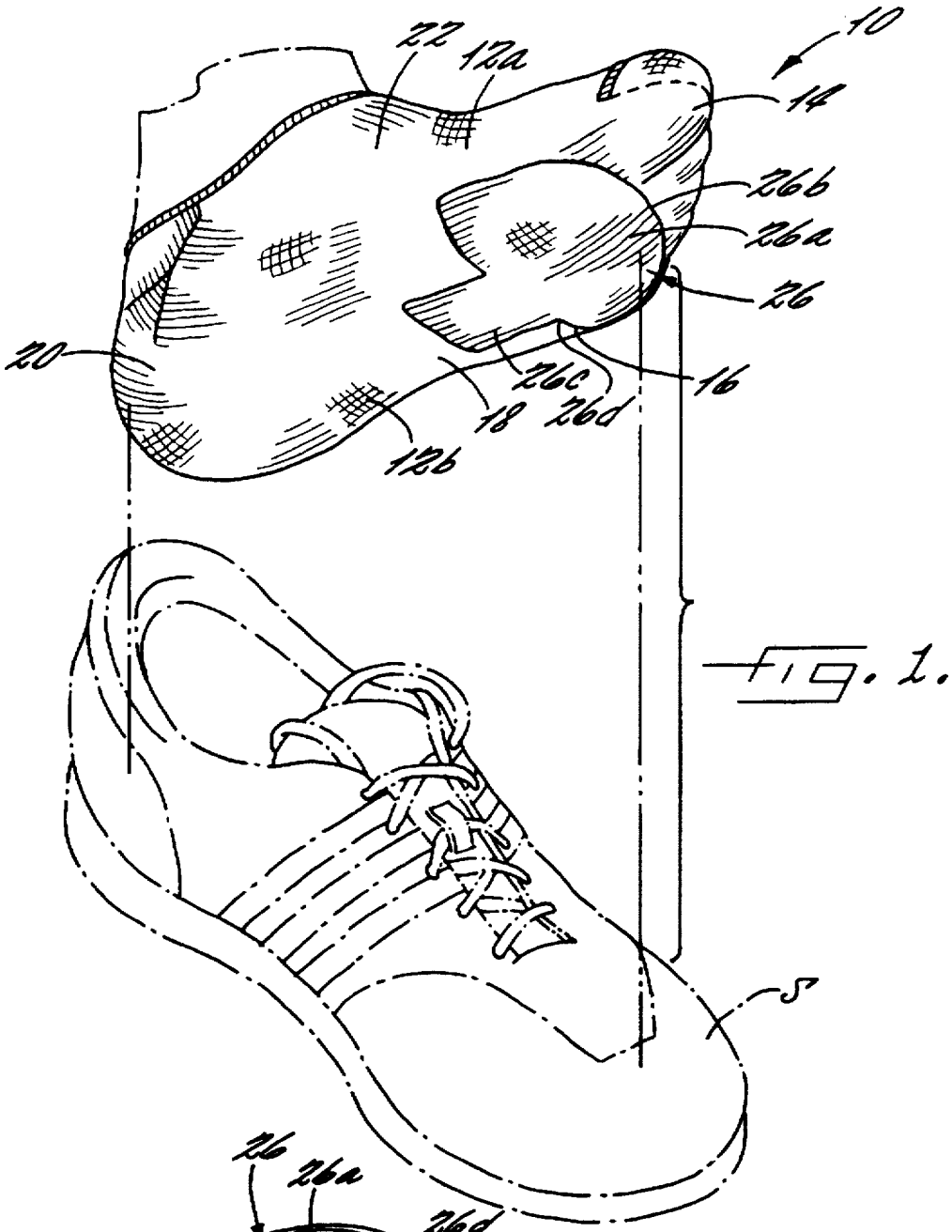
FIG. 1 is a perspective view of a foot of a wearer having a foot protector according to the present invention positioned thereon, and as it would appear prior to the insertion of the wearer's foot in the illustrated shoe S.
Figure 2:
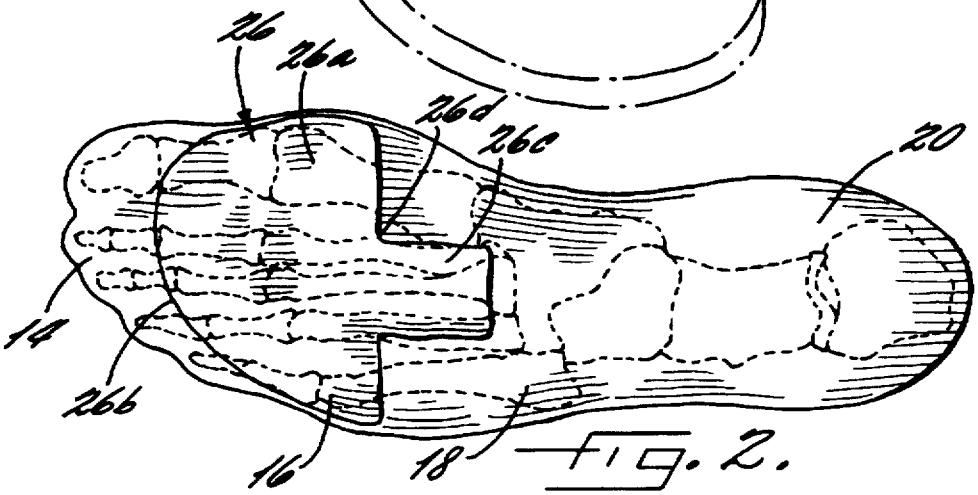
FIG. 2 is a bottom plan view of a foot protector according to the instant invention, illustrating an example of how the padding corresponds to the bones of a wearer's foot.

With reference to FIGS. 1 and 2, the foot protector according to the present invention, as illustrated generally at 10 as it appears on a wearer's foot prior to being inserted into shoe S, desirably has an upper half 12*a* and a lower half 12*b*. In this first embodiment of the present invention, the foot protector 10 is in the form of a typical sock construction, and includes a toe portion 14, a ball 16, an arch 18, a heel pocket 20, and an instep 22. Although illustrated as being a low top or tennis sock type construction, the foot protector 10 can be in the form of any type of foot covering such as a low cuff or bobbysock type sock or a knee sock. Similarly, although the toe portion 14 is illustrated as being in the form of a toe covering pocket, it is noted that the terminology "toe portion" is intended in its broadest context, to include toe portions which cover only a portion of or less than all of the toes, or in some way, cooperate with the toes of the wearer to position the foot protector in the appropriate position on a wearer's foot.

The foot protector 10 according to the present invention includes padding, shown at 26, which generally assumes the shape of a mushroom, and includes a main body or cap 26*a* having an arcuate edge 26*b*, a stem 26*c*, and edge portions 26*d* where the stem and main body connect to each other. As illustrated, this padding 26 is desirably positioned on the lower half 12*b* of the foot protector 10 so as to overlie at least a portion of the ball of a wearer's foot. The arcuate edge 26*b* of the padding 26 is desirably positioned such that it terminates proximate the juncture of the ball 16 and toe 14 portions of the foot protector and the corresponding portions of a wearer's foot. In this way, the transition between the padded portion 26 of the foot protector 10 and the relatively less padded portion of the toe portion 14 is positioned proximate the toe joints such that the transition avoids the pressure points of the wearer's foot (particularly those on the toe and ball pads), and therefore is not dramatically felt by the wearer. The main body or cap portion 26*a* of the padding 26 is desirably shaped substantially as a filled semicircle, to thereby cushion and protect the major joints located in the ball of a wearer's foot, while the arcuate front edge follows the contour of the juncture of the ball of the foot with the toes. A stem portion 26*c* is also desirably connected to the main body 26*a* of the pad 26 to extend rearwardly towards the heel of the wearer's foot. In one form of the invention, the stem 26*c* is positioned such that it covers a portion of the arch of a wearer's foot and fills the void typically located therebeneath.

The edges 26*d* where the stem connects to the main body or cap 26*a* can form substantially right angles as illustrated or alternatively can taper to form more rounded corners more closely approximating a true mushroom shape. In the embodiment of the invention having a substantially mushroom-shaped padding structure shown in FIGS. 1 and 2, the stem 26*c* is desirably from about ⅓ to ½ the length of the cap portion 26*a* of the pad. It is to be understood, however, that the shape and size of the stem 26*c* may vary somewhat and remain within the spirit of the present invention. The padding 26 is also desirably symmetrically shaped, so that the foot protector can be worn interchangeably on both a right and left foot. It has been found that padding having this configuration provides desirable support for all of the major pressure points of the wearer's foot but because extraneous regions of padding are eliminated, the foot protector does not tend to cause shoes to feel undesirably tight.

Figures 3, 4, 5:
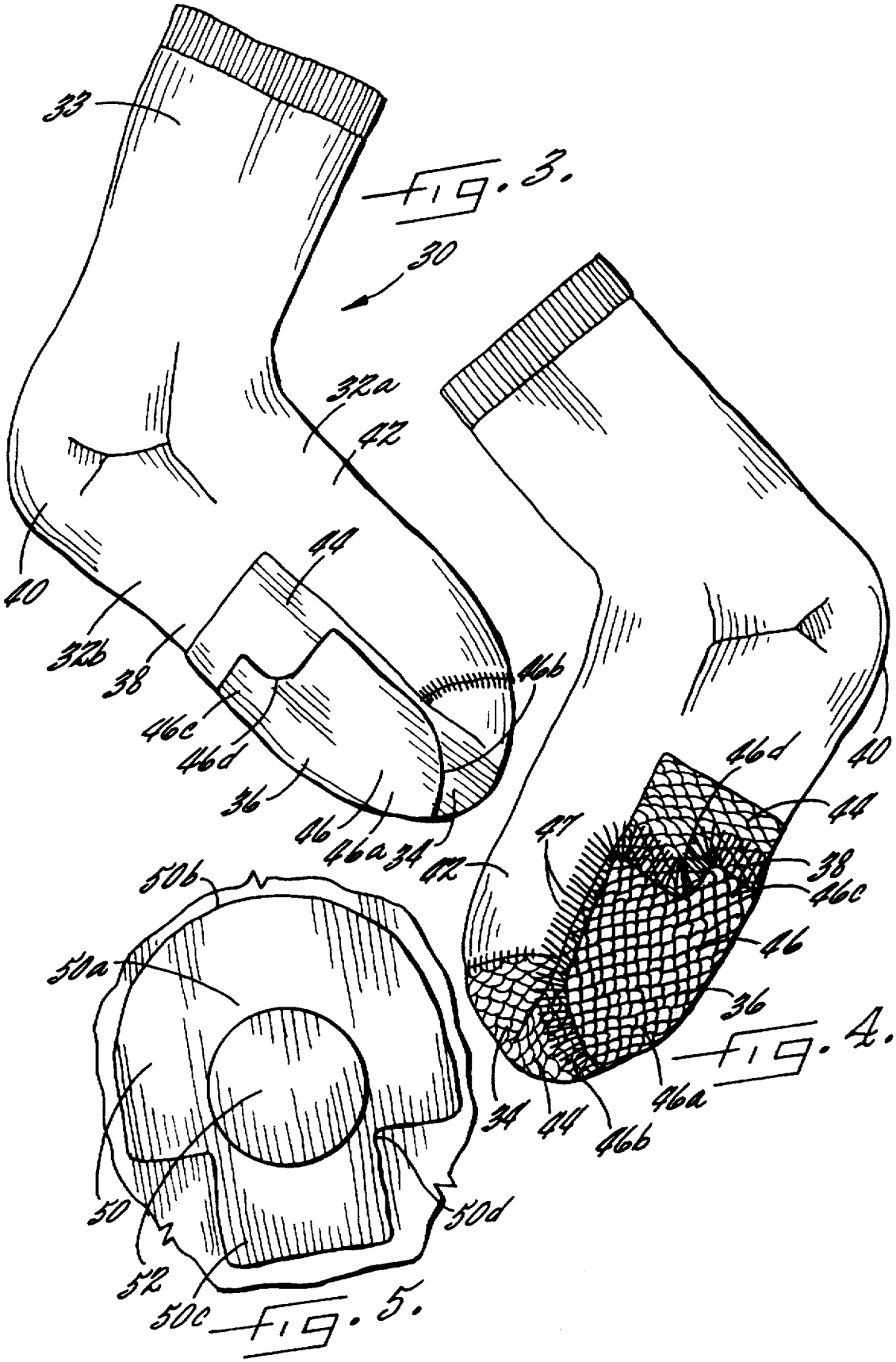
FIG. 3 is a side elevational view of a foot protector according to the present invention as it appears in its "right side out" form.
FIG. 4 is a side elevational view of the foot protector of FIG. 3, as it appears in an inverted (i.e. "inside out") condition.
FIG. 5 is an enlarged bottom plan view of an alternative pad structure according to the present invention.

FIGS. 3 and 4 illustrate an alternative embodiment of the present invention. The foot protector 30 illustrated in these figures is in the form of a dress sock, shown generally at 30, which has a low cuff 33. The foot protector 30 includes an upper half 32*a*, a lower half 32*b*, a toe portion 34 (shown as being a toe covering pocket), ball portion 36, arch portion 38, heel pocket 40, and instep 42. As illustrated, the toe portion 34, the ball portion 36, and the arch portion 38 comprise a first area of padding 44. This padding is desirably provided in the form of integrally knit terry loops, which form a background terry region on the foot protector. For example, this padding can be formed by chopping in additional yarns, i.e. auxiliary yarns, according to conventional methods to form terry loops in this region.

A second substantially mushroom-shaped padded area 46 is provided proximate the ball portion 36 of the foot protector 30. This second padded area 46 is relatively thicker than the first padded area 44 such that a greater amount of cushioning protection is provided in the mushroom-shaped region. The second padded area 46 desirably has an arcuate front edge 46*b* located proximate the toe portion 34 such that the transition from the relatively thicker padding 46 to the relatively thinner padded first portion 44 is located proximate the toe joints of the wearer's foot, where it is less likely to be felt by the wearer when the foot protector 30 is worn. In the form of the invention shown in FIGS. 3 and 4, this second padded area 46 is formed by chopping in one or more auxiliary yarns 47 to form a plurality of terry loops in the region. However, it will be readily recognized that other means for providing thickened padding portions can be used within the scope of the invention.

The second padded area 46 also desirably includes a stem portion 46*c*, which is joined to the cap 46*a* along first and second edges 46*d*. The first and second edges 46*d* are illustrated as being rounded to more closely approximate a true mushroom shape, as compared with the substantially right angled edges illustrated in FIGS. 1 and 2. The stem portion 46*c* is desirably positioned on the foot protector 30 to overlie at least a portion of the arch portion 38 of the protector and the corresponding area of a wearer's foot. It will be noted that in this embodiment of the invention, the background terry 44 reduces the severity of the transition from the second padded region 46 to surrounding portions of the foot protector, in addition to providing cushioning to underlying portions of a wearer's foot.

FIG. 5 illustrates a further alternative embodiment of the present invention. In this embodiment, a first padded region 50 is provided in the form of a substantially mushroom-shaped region. As with the padded regions discussed above, the first padded region 50 desirably includes a main body or cap portion 50*a*, which has an upper arcuate edge 50*b*, a stem portion 50*c* and edges 50*d* which join the stem to the main body. As with the previously discussed forms of the invention, the first padding region 50 is relatively thicker than the surrounding portions of the foot protector. In this embodiment of the invention, an additional padding region 52 is provided which preferably corresponds to a central portion of the arch of a wearer's foot located immediately adjacent the ball pad of the foot. In this way, the additional padded region 52 serves to fill in the space typically located proximate the metatarsal heads. In this form of the invention, the additional padded region 52 is desirably provided in a central portion of the substantially mushroom-shaped first padding, with the second padding region being relatively thicker than the first padding region. In this way, additional support can be provided for the portion of the arch immediately adjacent the ball pad of the wearer's foot. As discussed above, the edges 50*d* can be substantially right angles, as illustrated, or alternatively they can be more rounded such as those illustrated in FIG. 3. Though illustrated as being substantially circular, it is to be understood that the additional padding region 52 can be provided in other geometric shapes, locations and sizes relative to the first padded region 50, within the scope of the instant invention.

The foot protectors illustrated in FIGS. 1–5 are designed to be worn alone or in combination with other items of hosiery, such as underneath or over top of another pair of socks. In addition, the socks can be manufactured from any conventional type of yarns or combination thereof as will be recognized by those of ordinary skill in the art; for example, a nylon body yarn could be used to knit the foot protector body, with cotton yarns being chopped in to form the padding regions.

Figure 6:
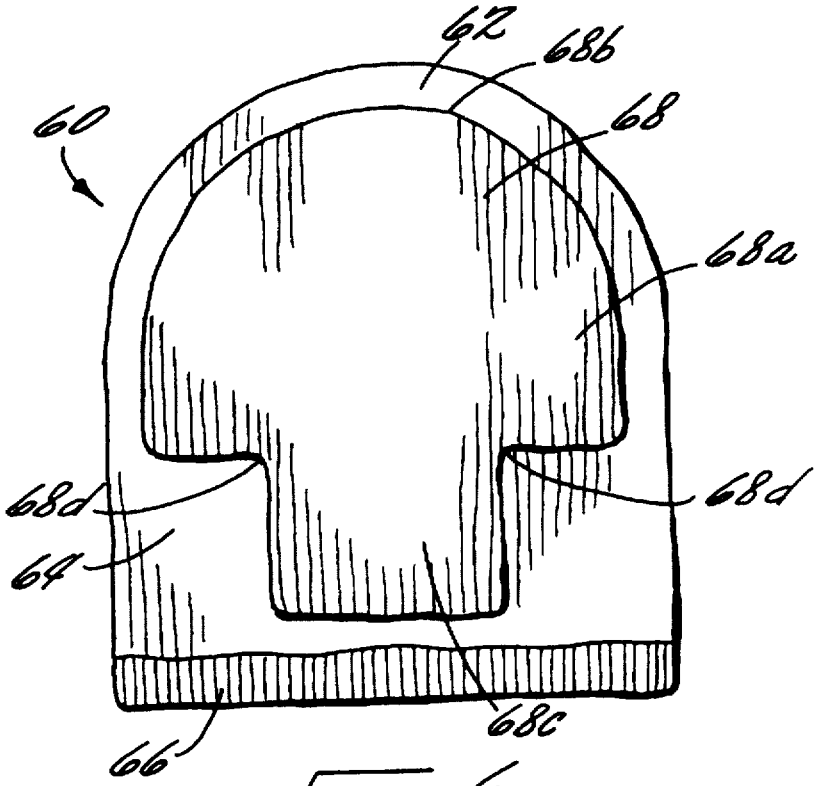
FIG. 6 is an elevational view of an alternative foot protector structure according to the present invention.

FIG. 6 illustrates a toe cap-type footlet according to the instant invention. In this form of the invention, the footlet 60 includes a toe portion 62 (illustrated as being in the form of a toe covering pocket) and a ball portion 64 in the manner of conventional toe and ball portions of a sock. However, in this form of an invention, the footlet 60 terminates in a circular band 66 which is preferably integrally knit with the footlet structure. As a result, the footlet 60 fits like a cap over the front end of a wearer's foot, and terminates in a band which extends circumferentially around the arch and instep of a wearer's foot.

The footlet 60 desirably includes a padded region 68 on at least a portion of the ball portion 64 of the footlet, with the padded region including an arcuate front edge 68*b* which is positioned to correspond at the juncture of the toe portion 62 and the ball portion 64 of the footlet, so that the transition of the relatively thicker padded region 68 to the relatively thinner toe portion 62 is positioned proximate the toe joints of a wearer and away from the pressure points of the feet, so that it avoids irritation of the pressure points. As shown, the padding region 68 is in the form of a substantially mushroom-shaped pad which, like the padding discussed above, desirably includes a main body 68*a* having an arcuate edge 68*b*, a stem 68*c* and edges 68*d* which connect the stem to the main body. The footlet 60 is designed to be worn either alone or in combination with other items of hosiery, and is designed to be worn with shoes which are cut low in certain areas without showing above the top of the shoe.

Foot protectors according to the instant invention are desirably produced on conventional knitting equipment used to produce socks, and are finished in a conventional manner such as by seaming the toe portion closed to form a closed toe pocket. The padding is preferably knit into the foot protector in the form of fed-in yarns which form a plurality of terry loops. This process is preferably performed by the process known in the knitting art as chopping, where the terry yarns are fed to the needles of the knitting machine by what are known as chopping yarn feed fingers. The number of loops, number of yarns forming the loops, loop length, loop compactness, and the like can be selected to provide the optimal amount of padding in the respective sections of the foot protector. In this way, the padding can be integrally formed in the foot protector as the protector is being knitted on a knitting machine, thereby enabling efficient and rapid production of the protectors. The loops are preferably adapted to intimately contact the skin of the wearer's feet, as the terry loops provide a comfortable surface to the wearer and the loops tend to assist in wicking moisture away from the wearer's feet. In addition, the type of yarns used to form the various sections of the foot protector can be selected to optimize cushioning, durability, moisture absorption, and the like.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A foot protector comprising:

a foot covering having at least a toe portion, a ball portion adjoining said toe portion, and an instep portion, and a first padded region located on at least a portion of said ball portion, said padded region having an arcuate front edge which terminates at a juncture of said toe portion and said ball portion, such that said arcuate front edge is located proximate the joints of the toes when the foot covering is positioned on a foot.

2. A foot protector according to claim 1, wherein said padded region is substantially mushroom shaped.

3. A foot protector according to claim 2, wherein said foot covering further includes an arch portion, and said substantially mushroom-shaped padded region defines a cap portion and a stem portion, and said stem extends along said arch portion of said foot covering.

4. A foot protector according to claim 1, wherein said padded region is symmetrically shaped.

5. A foot protector according to claim 1, wherein said foot covering is integrally knit, with said padded region being defined by a plurality of terry loops which form a thicker region than surrounding portions of the foot covering.

6. A foot protector according to claim 1, wherein said foot covering further includes an arch portion adjoining said ball portion, and further comprising a second padded portion positioned proximate a juncture of said arch portion and said ball portion.

7. A foot protector according to claim 1, wherein said foot covering is substantially cap-shaped and is sized to cover only a toe end of a foot.

8. A foot protector according to claim 7 wherein said foot covering terminates in a circular band.

9. A foot protector for enhancing the comfort of a wearer's foot comprising:

a knit foot covering including a toe pocket, ball portion, arch portion, heel portion and instep portion for collectively covering a portion of a foot and a first padded region positioned on at least a portion of said ball portion of said foot covering, said first padded region being defined by a thickened region of terry loops surrounded by relatively thinner knit material portions, wherein said first padded region terminates in an arcuate front edge located at a juncture of said toe pocket and said ball portion.

10. A foot protector according to claim 9, wherein said first padded region is substantially mushroom shaped and includes a stem portion which extends rearwardly toward the heel portion of said protector, and covers a portion of said arch portion.

11. A foot protector according to claim 9, wherein the relatively thinner knit material portions surrounding said first padded region comprises terry loops.

12. A foot protector according to claim 9, further comprising a second padded region positioned on said foot protector proximate a central portion of a juncture of said ball and arch portions.

13. A foot protector according to claim 9, wherein said first padded region is substantially mushroom shaped and includes a cap portion and a stem portion which extends rearwardly toward said heel portion, and further comprising a second relatively smaller padded region positioned on said first padded region proximate a juncture of said cap portion and said stem portion.

14. A foot protector according to claim 9, wherein said first padded region is substantially mushroom shaped and includes a cap portion and a stem portion which extends rearwardly toward said heel portion, and said stem portion has a length which is about ⅕ to ½ of the length of said cap portion.

15. A method of making a foot protector comprising the steps of:

knitting a plurality of courses from a base yarn to define toe, ball and instep portions, and while knitting said toe pocket and ball portion, feeding in an auxiliary yarn to form a series of terry loops defining a first padded region having an arcuate front edge located at a juncture of said toe portion and said ball portion.

16. A method of making a foot protector according to claim 15, further comprising the step of knitting to said ball and instep portions an arch portion, knitting to said arch and instep portions a circular band, and joining opposing sides of the toe portion to thereby form a cap-shaped footlet.

17. A method of making a foot protector according to claim 15, wherein the step of knitting a plurality of courses from a base yarn to define toe, ball and instep portions includes knitting an arch portion and heel pocket, and further comprising the step of joining opposing sides of the toe portion to thereby form a sock-shaped foot protector.

18. A method of making a foot protector according to claim 15, further comprising the step of knitting to said ball and instep portions an arch portion, and while knitting said arch portion, feeding in an auxiliary yarn to form a series of terry loops on at least a section of the arch portion to define a second padded region thereon.

* * * * *